US009962052B2

(12) United States Patent
Conrad

(10) Patent No.: US 9,962,052 B2
(45) Date of Patent: May 8, 2018

(54) SURFACE CLEANING APPARATUS

(75) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 500 days.

(21) Appl. No.: 14/003,160

(22) PCT Filed: Mar. 5, 2012

(86) PCT No.: PCT/CA2012/000194

§ 371 (c)(1),
(2), (4) Date: Nov. 11, 2013

(87) PCT Pub. No.: WO2012/119226

PCT Pub. Date: Sep. 13, 2012

(65) Prior Publication Data

US 2014/0053367 A1 Feb. 27, 2014

Related U.S. Application Data

(63) Continuation-in-part of application No. 13/040,695, filed on Mar. 4, 2011, now abandoned.

(51) Int. Cl.
*A47L 7/00* (2006.01)
*A47L 9/16* (2006.01)
(Continued)

(52) U.S. Cl.
CPC ..... *A47L 9/1608* (2013.01); *A47L 5/24* (2013.01); *A47L 5/362* (2013.01); *A47L 7/0023* (2013.01);
(Continued)

(58) Field of Classification Search
None
See application file for complete search history.

(56) References Cited

U.S. PATENT DOCUMENTS 5,268,845 A 12/1993 Startup et al.
5,402,059 A 3/1995 Bittar
(Continued)

FOREIGN PATENT DOCUMENTS

CA 2420497 6/2011
CN 201529088 U 7/2010
(Continued)

OTHER PUBLICATIONS

International Search Report for PCT/CA2012/000194 dated Jun. 19, 2012.
(Continued)

*Primary Examiner* — Christopher M Koehler
*Assistant Examiner* — Brian Keller
(74) *Attorney, Agent, or Firm* — Philip C. Mendes da Costa; Bereskin & Parr LLP/ S.E.N.C.R.L., s.r.l.

(57) ABSTRACT

A surface cleaning apparatus comprises an air flow path extending from a dirty air inlet to a clean air outlet and includes a suction motor. The surface cleaning apparatus may be battery powered and/or may have a power requirement of 200 Watts or less. A cyclone chamber is provided in the air flow path and has an air outlet which is covered by a screen. In one embodiment, there is an absence of a vortex finder. In another embodiment, a vortex finder that extends into the cyclone chamber less than the height of the cyclone inlet and optionally less than the height of the cyclone inlet may be provided.

12 Claims, 14 Drawing Sheets

(51) Int. Cl.
*A47L 5/24* (2006.01)
*A47L 5/36* (2006.01)

(52) U.S. Cl.
CPC ..... *A47L 7/0038* (2013.01); *A47L 9/1666* (2013.01); *A47L 9/1683* (2013.01)

(56) References Cited

U.S. PATENT DOCUMENTS

| | | | | |
|---|---|---|---|---|
| 5,694,029 | A | 12/1997 | Hayes et al. | |
| 5,742,153 | A | 4/1998 | McEachern et al. | |
| 5,798,633 | A | 8/1998 | Larsen et al. | |
| 5,831,420 | A | 11/1998 | Myers | |
| 6,031,357 | A | 2/2000 | Yano et al. | |
| 6,081,104 | A | 6/2000 | Kern | |
| 6,307,358 | B1 | 10/2001 | Conrad | |
| 6,311,366 | B1 | 11/2001 | Sepke et al. | |
| 6,457,205 | B1 | 10/2002 | Conrad | |
| 6,891,355 | B2 | 5/2005 | Kernahan | |
| 6,909,266 | B2 | 6/2005 | Kernahan et al. | |
| 7,135,051 | B2 | 11/2006 | Baldinger et al. | |
| 7,159,270 | B2 | 1/2007 | Genoa et al. | |
| 7,163,568 | B2 | 1/2007 | Sepke et al. | |
| 7,171,724 | B2 | 2/2007 | Follegot et al. | |
| 7,291,193 | B2 | 11/2007 | Oh et al. | |
| 8,225,456 | B2 | 7/2012 | Hakan et al. | |
| 2001/0048295 | A1 | 12/2001 | Joch | |
| 2002/0073663 | A1* | 6/2002 | Sepke | A47L 5/28 55/467 |
| 2002/0178701 | A1 | 12/2002 | Oh et al. | |
| 2003/0173940 | A1 | 9/2003 | Kovarik et al. | |
| 2003/0200622 | A1 | 10/2003 | Park et al. | |
| 2004/0051510 | A1 | 3/2004 | Saggini et al. | |
| 2004/0095118 | A1 | 5/2004 | Kernahan | |
| 2006/0037291 | A1 | 2/2006 | Oh et al. | |
| 2006/0042039 | A1* | 3/2006 | McDowell | A47L 5/362 15/353 |
| 2006/0090428 | A1* | 5/2006 | Park | A47L 9/1625 55/337 |
| 2006/0156508 | A1 | 7/2006 | Khalil | |
| 2007/0200540 | A1 | 8/2007 | Hashimoto et al. | |
| 2007/0209334 | A1* | 9/2007 | Conrad | A47L 5/28 55/337 |
| 2007/0226946 | A1 | 10/2007 | Best | |
| 2008/0040883 | A1 | 2/2008 | Beskow et al. | |
| 2008/0134460 | A1 | 6/2008 | Conrad | |
| 2008/0172995 | A1* | 7/2008 | Conrad | A47L 9/1608 55/345 |
| 2008/0191675 | A1 | 8/2008 | Besser et al. | |
| 2008/0244858 | A1 | 10/2008 | Shaver et al. | |
| 2010/0083833 | A1 | 4/2010 | Morphey | |
| 2010/0132319 | A1 | 6/2010 | Ashbee et al. | |
| 2010/0175217 | A1 | 7/2010 | Conrad | |
| 2010/0175219 | A1 | 7/2010 | Soen et al. | |
| 2010/0229321 | A1 | 9/2010 | Dyson et al. | |
| 2010/0242209 | A1 | 9/2010 | Beskow et al. | |
| 2011/0225764 | A1* | 9/2011 | Muhlenkamp | A47L 9/1666 15/347 |
| 2011/0289719 | A1 | 12/2011 | Han et al. | |
| 2012/0222259 | A1 | 9/2012 | Conrad | |

FOREIGN PATENT DOCUMENTS

| | | | |
|---|---|---|---|
| FR | 2940901 | A1 | 7/2010 |
| JP | 2010227287 | A | 10/2010 |
| WO | 1995022190 | | 8/1995 |
| WO | 2003034566 | | 4/2003 |
| WO | 2003090596 | | 6/2003 |
| WO | 2004041054 | | 5/2004 |
| WO | 2007136675 | A2 | 11/2007 |
| WO | 2008070962 | A1 | 6/2008 |

OTHER PUBLICATIONS

International Preliminary Report on Patentability and Written Opinion for PCT/CA2012/000194 dated Sep. 19, 2013.

* cited by examiner

SURFACE CLEANING APPARATUS

FIELD

The disclosure relates to surface cleaning apparatuses, such as vacuum cleaners having a suction motor that may produce a reduced air flow, such as a battery operated vacuum cleaner.

INTRODUCTION

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone. Cyclonic vacuum cleaners include a vortex finder that extends into the interior of the cyclone chamber and defines an air exit passage for the cyclone chamber. In addition, a screen is provided around the opening of the vortex finder to prevent hair and larger dirt particles from exiting the vacuum cleaner.

SUMMARY

The following summary is provided to introduce the reader to the more detailed discussion to follow. The summary is not intended to limit or define the claims.

One of the heaviest individual components of a vacuum cleaner may be the suction motor. The suction motor is an assembly that comprises an impeller or fan and a motor to drive the impeller or fan. Typically, vacuum cleaners use a clean air motor. Accordingly, the dirty air that is drawn into the vacuum cleaner is treated (e.g., filtered, subjected to cyclonic air separation) prior to the air passing by the suction motor. The suction motor must produce sufficient suction to draw air through the air flow passage through the vacuum cleaner, including through the air treatment members.

In order to produce a lighter vacuum cleaner, a smaller suction motor may be used. However, smaller motors typically produce less suction. An important factor in the cleaning efficiency of a vacuum cleaner is the velocity of the air flow at the dirty air inlet. The greater the velocity, the greater the amount of dirt and other particulate matter that may be entrained in an air stream and drawn into the vacuum cleaner. For example, a dirty air inlet in a floor cleaning head may have a length (in the direction transverse to the forward direction of motion) of from e.g. 7 to 12 inches and preferably from 9 to 11 inches and a width (in the direction of forward motion) of from e.g., 0.5 to 4 inches and preferably 1 to 3 inches. If the size of the dirty air inlet is maintained constant and no other changes are made to the air flow path through the vacuum cleaner, then reducing the amount of suction produced by a suction motor will reduce the cleaning efficiency of a vacuum cleaner.

According to one broad aspect of this disclosure, a vacuum cleaner, or other surface cleaning apparatus, is provided wherein a screen is provided in the cyclone chamber but a vortex finder is not provided. The screen may be of any typical design that may be used to prevent hair and larger particulate matter from exiting the cyclone chamber. Accordingly, the screen may be a shroud (e.g., a molded plastic member having openings or perforations therein), or a mesh (e.g., metal or synthetic such as nylon) provided on a support frame.

It has been surprising determined that a vacuum cleaner which has an absence of a typical vortex finder may have improved performance despite the absence of the vortex finder, particularly in low air flow vacuum cleaners. It has been determined that a vortex finder produces back pressure. This back pressure provides a resistance to flow through the vacuum cleaner and, no other changes being made, reduces the velocity of the air flow at the dirty air inlet. At the same time, the absence of the vortex finder does not materially affect the efficiency of the cyclone chamber. Therefore, the cleaning performance of the surface cleaning apparatus may be improved.

According to another broad aspect of this disclosure, a vacuum cleaner, or other surface cleaning apparatus, is provided wherein a cyclone chamber is provided with a vortex finder that extends into the cyclone chamber less than the height of the cyclone air inlet. It has also been surprisingly determined that even by reducing the size of, (without making any other change) the cleaning performance of the surface cleaning apparatus may be improved.

The vacuum cleaner, or other surface cleaning apparatus is preferably an upright vacuum cleaner and the suction motor may have a power requirement of 200 Watts or less. The surface cleaning apparatus may be battery powered, or may be connectable to an external power source, or both. Preferably, the surface cleaning apparatus is battery operated.

While a battery pack having a large power capacity may be provided so as to provide a high level of current for an extended period of time, the weight of the battery pack may be excessive for use in a vacuum cleaner. However, if the weight of the battery pack is reduced, then the operating life between charges may be low or the air flow produced by the surface cleaning apparatus may result in poor cleaning performance. In such a case, reducing the size of, or eliminating the vortex finder may result in an improvement in cleaning performance.

Accordingly, the cyclone air outlet may comprise a passage that extends into the cyclone chamber less than the height of the cyclone inlet and may be an opening in an end wall of the cyclone chamber which is covered by a screen. In particular, the surface cleaning apparatus may be operable without having a traditional, non-permeable outlet conduit or vortex finder extending into the cyclone chamber. In this configuration the screen may provide the function of a traditional vortex finder under certain air flow conditions.

In one embodiment in accordance with one broad aspect, a battery operated surface cleaning apparatus comprises an air flow path extending from a dirty air inlet to a clean air outlet and includes a suction motor. A cyclone chamber may be provided in the air flow path. The cyclone chamber may comprise a cyclone air inlet having a height, a cyclone air outlet and a screen surrounding the cyclone air outlet. The cyclone air outlet may comprise a passage that extends into the cyclone chamber less than the height of the cyclone inlet. The surface cleaning apparatus may also include at least one battery operably connected to the suction motor.

In another embodiment in accordance with this broad aspect, a surface cleaning apparatus may also comprise an air flow path extending from a dirty air inlet to a clean air outlet and includes a suction motor having a power requirement of 200 Watts or less. A cyclone chamber may be provided in the air flow path and may comprise a cyclone air inlet having a height, a cyclone air outlet and a screen surrounding the cyclone air outlet. The cyclone air outlet may comprise a passage that extends into the cyclone chamber less than the height of the cyclone inlet.

In one embodiment in accordance with another broad aspect, a surface cleaning apparatus comprises an air flow passage extending from a dirty air inlet to a clean air outlet, a cyclone chamber positioned in the air flow passage and having an end wall, a cyclone air inlet and a cyclone air outlet, the cyclone air outlet comprising an opening in the end wall of cyclone chamber, a screen positioned in the cyclone chamber upstream of the cyclone air outlet, the screen having an outlet end, the outlet end of the screen is open and defines an airflow passage which is at least the same size as an airflow passage defined by the cyclone air outlet and, a suction motor positioned in the air flow passage.

In another embodiment in accordance with this other broad aspect, a surface cleaning apparatus may also comprise an air flow passage extending from a dirty air inlet to a clean air outlet, a cyclone chamber positioned in the air flow passage and having a cyclone air inlet and an end wall having a cyclone air outlet, a screen positioned in the cyclone chamber upstream of the cyclone air outlet, the screen having an outlet end and an absence of a centrally positioned vortex finder and, a suction motor positioned in the air flow passage Any of the embodiments described herein may have one or more of the following features.

The screen may have an interior volume that is fully open.

The screen may include a solid wall facing the cyclone air inlet. The solid wall may have a height that is greater than a height of the cyclone air inlet. Alternately or in addition, the solid wall ma have a distal end spaced from an end wall of the cyclone chamber by a first distance and the cyclone air inlet may have a distal end spaced from an end wall of the cyclone chamber by a second distance and the first distance may be greater than the second distance. Alternately or in addition, the air may rotate may in the cyclone chamber in a direction and the height of the solid wall may decrease in the direction. Alternately or in addition, the air entering the cyclone chamber may rotate around the screen in a direction and the air rotating in the direction adjacent the screen may have a height and the height of the solid may be greater than the height of the air.

The cyclone air outlet may include a collar positioned adjacent the screen extending inwardly into the screen a distance up to the height of the air inlet and preferably less than half the height of the cyclone air inlet.

The cyclone air outlet may be provided in the end wall and the outlet end of the screen may be positioned adjacent the end wall.

The cyclone air outlet may have a diameter and the screen adjacent the cyclone air outlet may have an open end having a diameter proximate the diameter of the cyclone air outlet.

The outlet end of the screen may be open and define an airflow passage which is at least the same size as an airflow passage defined by the cyclone air outlet.

The at least one battery or surface cleaning apparatus may produce less than 50 air watts and an air flow rate less than 1.3 $m^3$/minute.

The at least one battery or surface cleaning apparatus may produce less than 40 air watts and an air flow rate less than 1.2 $m^3$/minute.

The at least one battery or surface cleaning apparatus may produce less than 30 air watts and an air flow rate less than 1.1 $m^3$/minute.

The passage may be provided in a wall of the cyclone chamber and may have a thickness proximate a thickness of the wall.

The cyclone air inlet and the cyclone air outlet may be provided at a first end of the cyclone chamber.

The cyclone chamber may comprise a dirt outlet and the dirt outlet may be at a second end of the cyclone chamber opposed to the first end.

The screen may have a plurality of openings that are less than 8 mm in size, preferably less than 6 mm in size, more preferably less than 4 mm in size, and still more preferably less than 2 mm in size.

The screen may be cylindrical in shape.

The screen may be frusto-conical in shape.

The screen may have a height that is from 0.5 to 4 times the height of the cyclone air inlet.

The screen may have a height that is from 1 to 3 times the height of the cyclone air inlet.

The screen may have a height that is about twice the height of the cyclone air inlet.

DRAWINGS

Reference is made in the detailed description to the accompanying drawings, in which.

DETAILED DESCRIPTION

Figure 1:
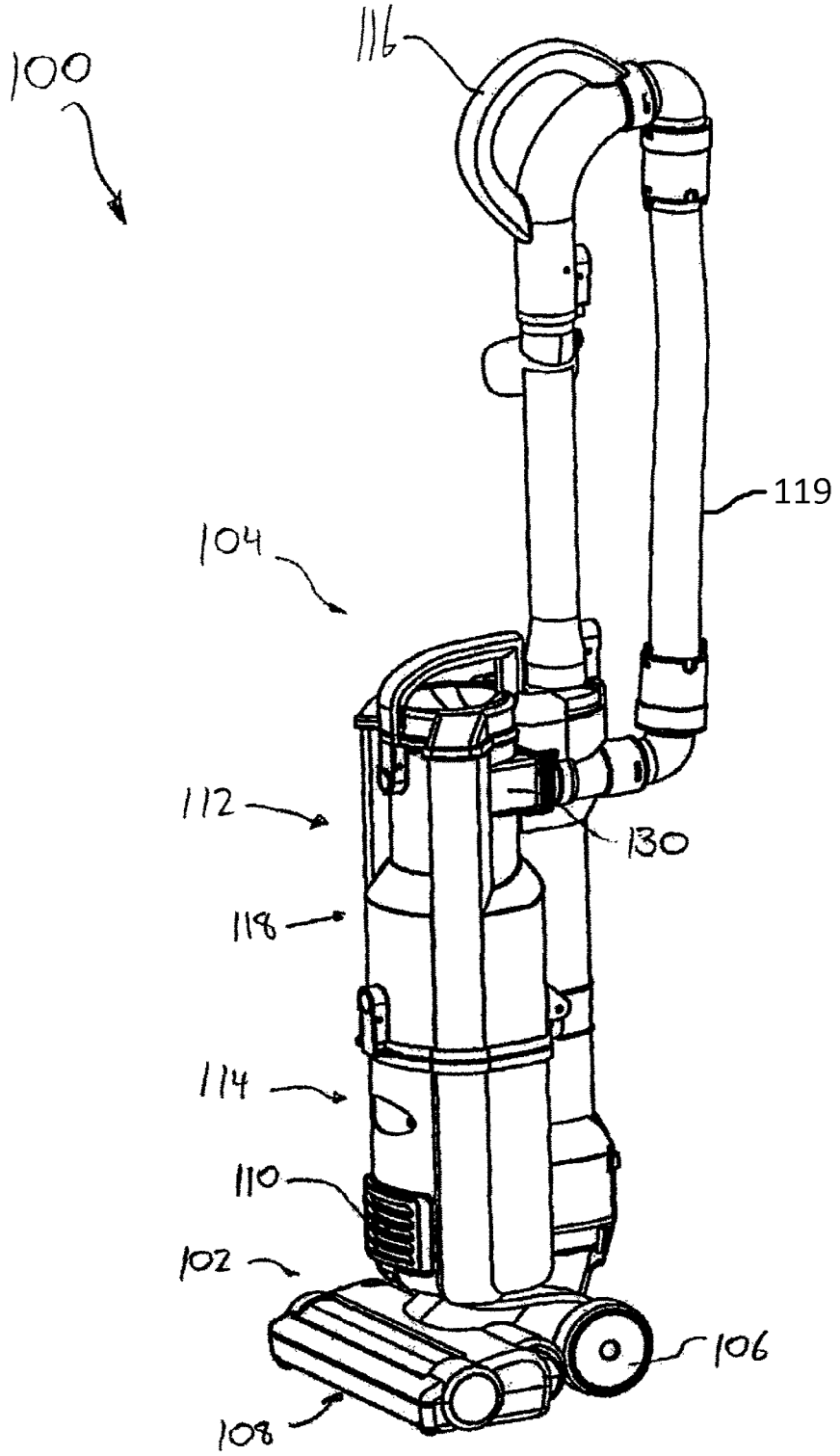
FIG. 1 is a perspective view of an embodiment of a surface cleaning apparatus.
Figure 2:
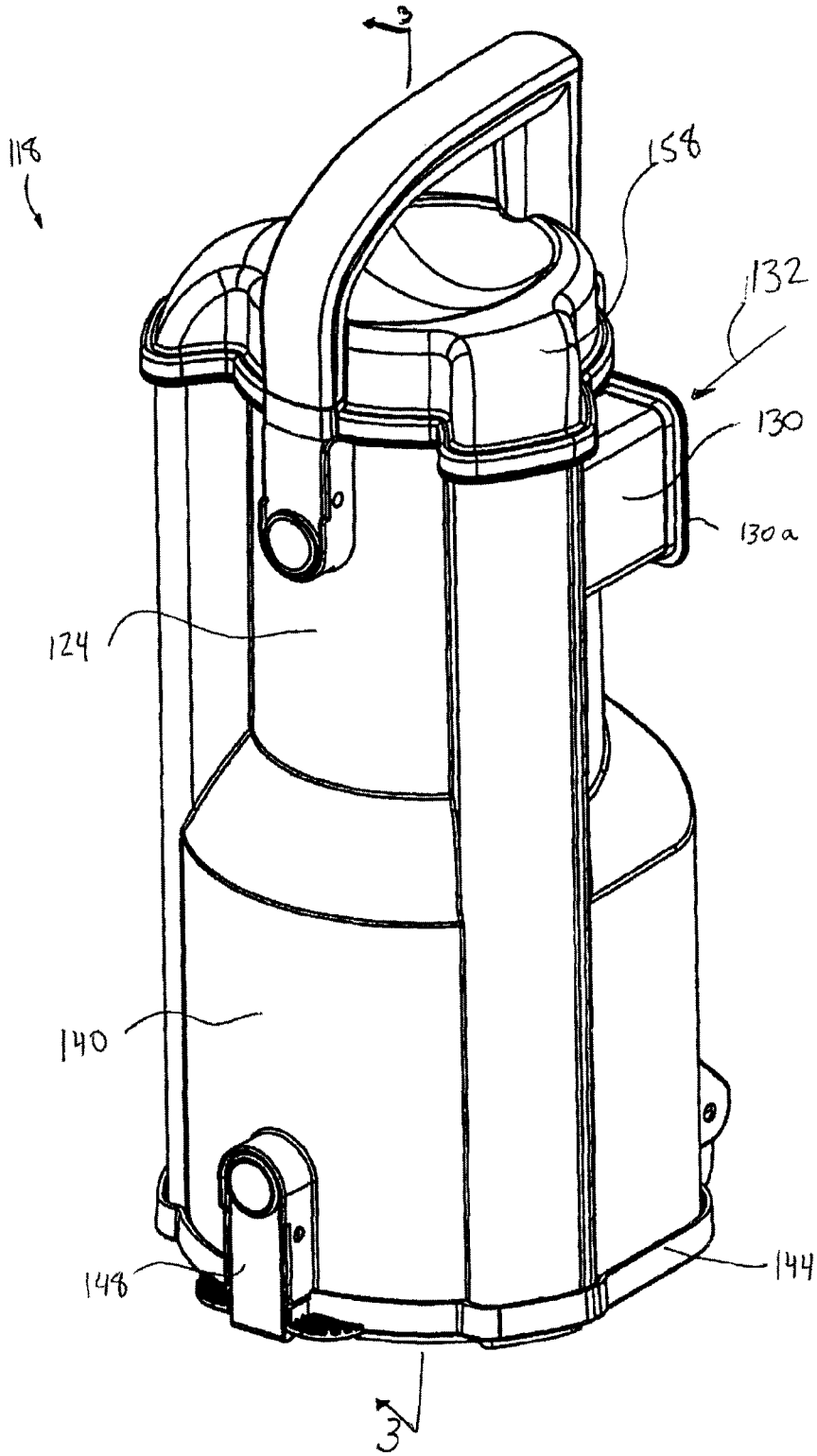
FIG. 2 is a perspective view of a cyclone bin assembly useable with the surface cleaning apparatus of FIG. 1.

Referring to FIG. 1, an embodiment of a surface cleaning apparatus 100 is shown. In the embodiment illustrated, the surface cleaning apparatus 100 is a full size upright vacuum cleaner. In alternate embodiments, the surface cleaning apparatus may be another suitable type of surface cleaning apparatus, including, for example, a hand vacuum cleaner, a canister vacuum cleaner, a stick vac, a wet-dry vacuum cleaner and a carpet extractor.

The surface cleaning apparatus 100 may comprise an electrical cord to connect to an external power source, including, for example, a standard electrical outlet. Alternatively, or in addition to being connectable to an external power source, the surface cleaning apparatus 100 may comprise an onboard power source, including, for example one or more batteries. Optionally, the on board battery may be rechargeable, preferably while mounted to the surface cleaning apparatus 100.

As exemplified in FIG. 1, the surface cleaning apparatus 100 includes a surface cleaning head 102 and an upper section 104. The surface cleaning head 102 preferably includes a pair of rear wheels 106 and a pair of front wheels (not shown) for rolling across a surface and a dirty air inlet 108 towards the front. The upper section 104 is moveably connected to the surface cleaning head 102 (e.g., pivotally mounted) between an upright storage position and an inclined in use position. It will be appreciated that the cleaning head and upright section may be of any design known in the art.

An air flow passage extends from the dirty air inlet 108 to a clean air outlet 110, which is preferably provided on the upper section 104. A handle 116, which is preferably connected to the upper section 104, is provided for manipulating the surface cleaning apparatus 100.

Preferably, as exemplified, the upper section 104 comprises an air treatment housing 112 and a suction motor housing 114. The air treatment housing 112 houses an air treatment member, which is positioned in the air flow passage downstream from the dirty air inlet 108, to remove dirt particles and other debris from the air flowing through the air flow passage. In the illustrated example, the air treatment member comprises a cyclone bin assembly 118 comprising a cyclone chamber 120 and a dirt collection chamber 122. The air treatment member may also comprise one or other air treatment members such as one or more cyclones or filters The suction motor housing 114 is configured to house a suction motor (not shown). Preferably, as exemplified, the suction motor is in air flow communication with the air flow passage, downstream from the cyclone bin assembly 118. Air exiting the cyclone bin assembly 118 may flow into a suction motor and exit the surface cleaning apparatus via the clean air outlet 110. The suction motor is preferably provided below the cyclone air outlet.

A hose 119 may be positioned in the air flow passage upstream of the cyclone bin assembly 118. As shown, the hose 119 may have a round cross-sectional shape.

As exemplified in FIGS. 2-5, the cyclone bin assembly 118 comprises a cyclonic chamber 120 and a separate dirt collection chamber 122 exterior to the cyclone chamber. The cyclone chamber and the dirt collection chamber may be of any configuration and may be in any orientation.

Air circulating within the cyclone chamber 120 enters via a cyclone or tangential air inlet 130 (which has an inlet end 130*a* and an outlet end 130*b*) and exits via a cyclone air outlet. As exemplified, cyclone chamber 120 is an upright cyclone chamber (e.g., the air enters and exits at the upper end of the cyclone chamber and the separated dirt exits at the lower end). In an alternate embodiment, the cyclone may be an inverted cyclone chamber (e.g., the air enters and exits at the lower end of the cyclone chamber and the separated dirt exits at the upper end). It will be appreciated that the air inlets and air outlets may be of various known designs.

As exemplified, the cyclone chamber 120 comprises a sidewall 124, a first (e.g., upper) end wall 126, an opposed second (lower) end wall or floor 128 and a longitudinal axis 138. A tangential or cyclone air inlet 130, in air flow communication with the dirty air inlet 108, is provided, preferably in the sidewall 124 for receiving a particle laden fluid stream, represented by arrow 132. As the fluid stream 132 circulates within the cyclone chamber 120, dirt particles and other debris may be disentrained from the fluid stream 132. Dirt particles and other debris separated from the fluid stream 132 may exit the cyclone chamber 120 through a dirt outlet 134, and are collected in the dirt collection chamber 122. The cyclone chamber 120 is exemplified in an upright configuration (e.g., e.g., the cyclone axis 138 extends generally vertically). However, it will be appreciated that the cyclone chamber may be provided in various orientations.

Preferably, the dirt outlet 134 comprises a gap provided between the sidewall 124 of the cyclone chamber 120 and the second (lower) end wall 128. The gap may extend part way or all the way around sidewall 124. Preferably, as exemplified, the dirt outlet comprises a slot 136 that extends part way around sidewall 122 between the end of sidewall 124 facing second end wall 128 and the second end wall 128. Debris separated from the air flow in the cyclone chamber 120 may travel from the cyclone chamber 120, through the dirt outlet 158 to the dirt collection chamber 122. Alternately, for example, the dirt outlet may be an opening in the second end wall or floor 128 and a plate may be provided at or facing the opening.

As exemplified, the dirt collection chamber 122 is separate from and positioned below the cyclone chamber 120. It will be appreciated that, in alternate designs, the dirt collection chamber may be internal to the cyclone chamber (e.g., it may comprise the bottom section of a cyclone chamber) or it may be positioned beside the cyclone chamber.

As exemplified, the dirt collection chamber 122 comprises a sidewall 140, a first end wall 144 and an opposed second end wall or floor 144. The dirt collection chamber may be emptyable by any means known in the art. For example an end wall may be openable (e.g., moveable to an open position or removably mounted). Preferably, the floor 144 is pivotally connected to the dirt collection chamber 122, such as by hinges 146, and may be rotated between a closed position (FIG. 2) and an open position (not shown). The floor 144 can be held in the closed position by any means known in the art, such as a releasable latch 148, or other suitable closure mechanism.

The cyclone chamber may be openable concurrently with the dirt collection chamber. As exemplified, the floor 128 of the cyclone chamber may be movable with the floor of the dirt collection chamber 144 to allow dirt retained in the cyclone chamber 120 to be emptied when the dirt collection chamber 122 is opened. In the illustrated example, the floor 128 of the cyclone chamber 120 is supported above the floor 144 of the dirt collection chamber 122 on a support member 150.

Figure 5:
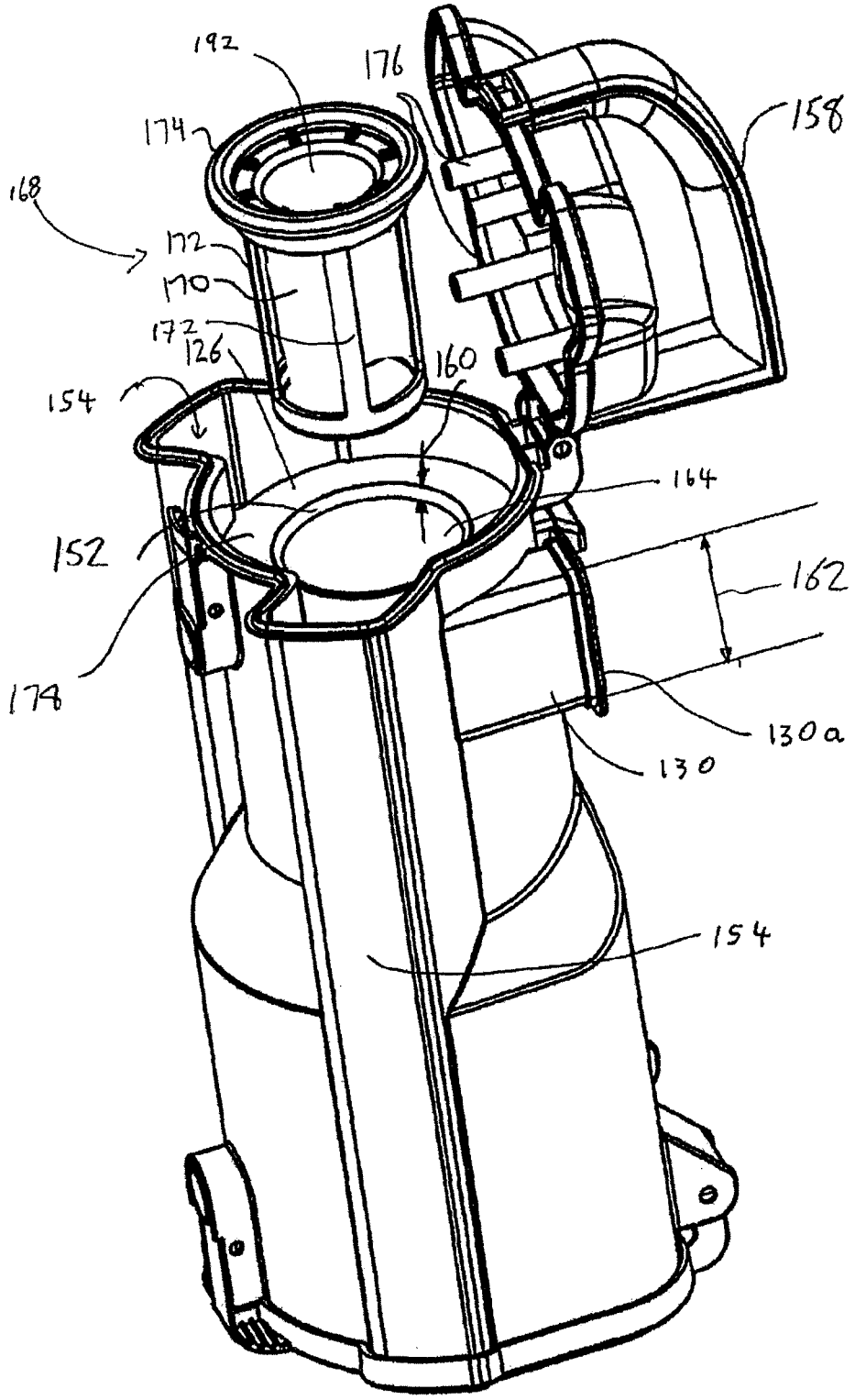
FIG. 5 is the perspective view of FIG. 4, with the screen removed and with the mesh removed.
Figure 6:
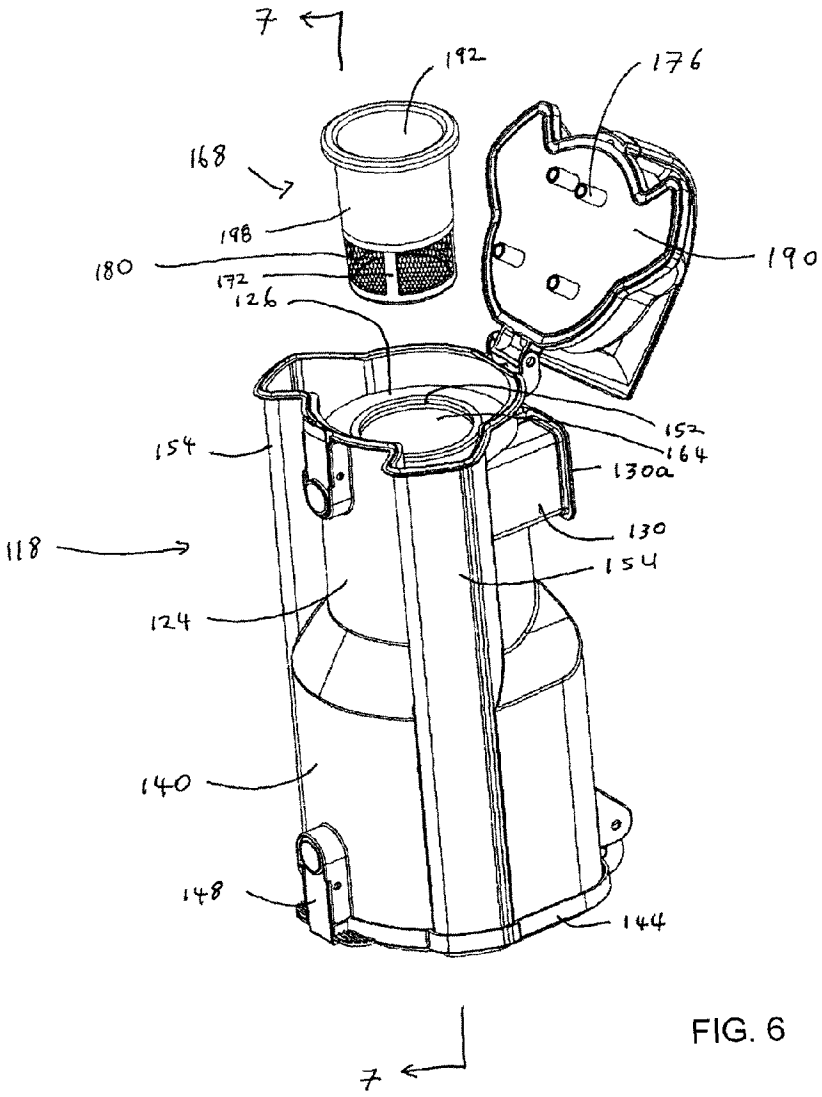
FIG. 6 is the perspective view of the cyclone bin assembly of FIG. 2, with an alternate screen removed.
Figure 7:
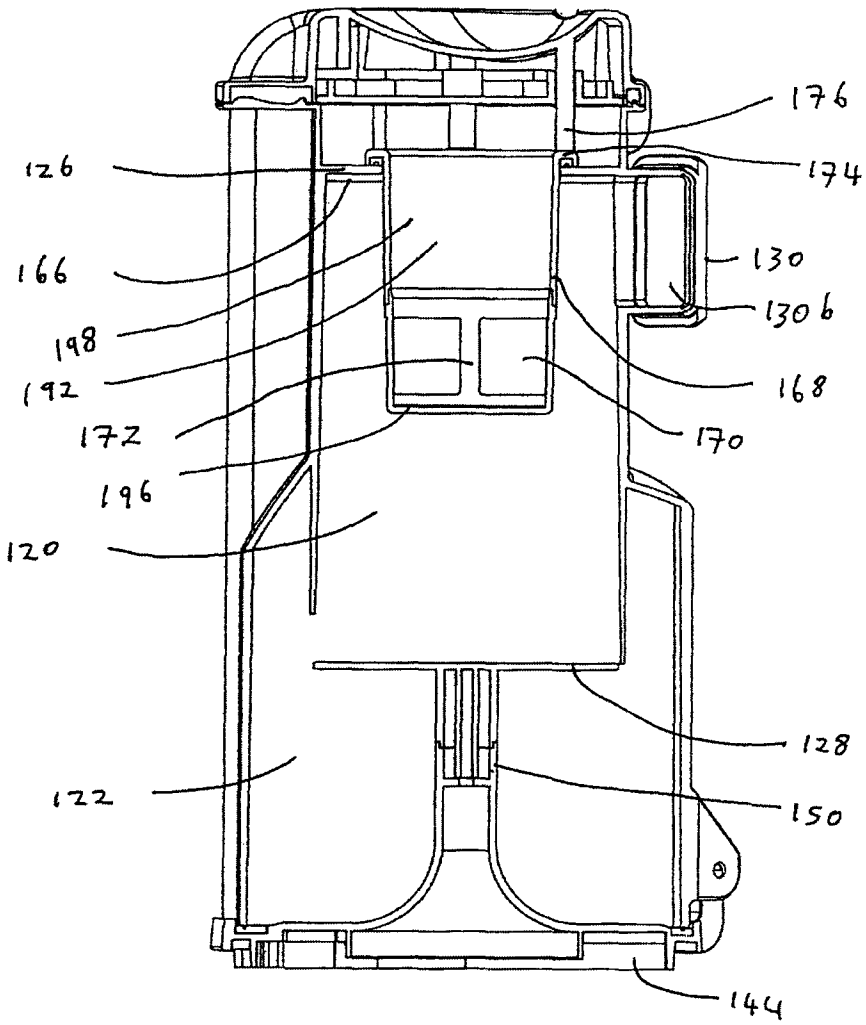
FIG. 7 is a section view of the cyclone bin assembly of FIG. 6, taken along line 7-7 in FIG. 6 with the mesh removed from the screen.

As exemplified in FIG. 5, the cyclone air outlet comprises an opening 152 in the first end wall 126 of cyclone chamber 160 which has a thickness 160. Screen 168 is positioned to cover opening 152. Opening 152 is in airflow communication with, preferably, a pair of external outlet down ducts 154. In the illustrated example, the passage 152 and down ducts 154 are in airflow communication by an air outlet chamber or plenum 156 that is located between the first end wall 126 of the cyclone chamber 120 and the inner surface 190 of the lid 158. The downstream ends of the down ducts 154 are in fluid communication with the suction motor. It will be appreciated that the passage from the cyclone outlet to the clean air outlet may be of various configurations and may include one or more filters as is known in the art.

In one aspect of this disclosure, the cyclone air outlet has an absence of a vortex finder. Accordingly, the cyclone air outlet is defined by opening 152 in the first end wall 126 that is covered by screen 168. Preferably, as exemplified, the screen 168 has an interior volume 192 that is fully open. As such, the screen does not have a conduit or other structure that extends from end wall 126 downwardly into interior volume 192 of screen 168. Air with enters the interior volume 192 may flow unimpeded through opening 152.

Figure 3:
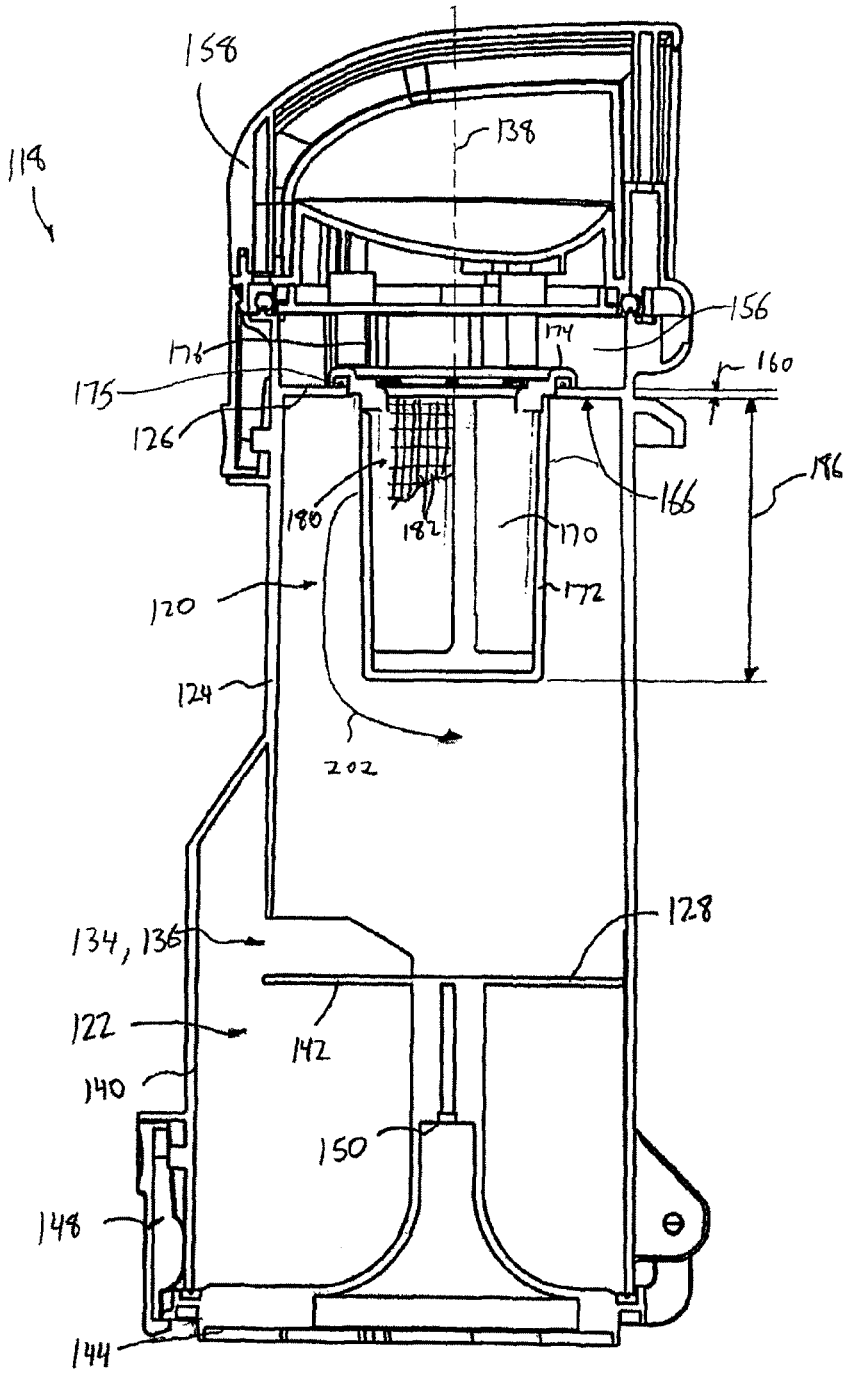
FIG. 3 is a section view of the cyclone bin assembly of FIG. 2, taken along line 3-3 in FIG. 2 with part of the mesh removed.
Figure 4:
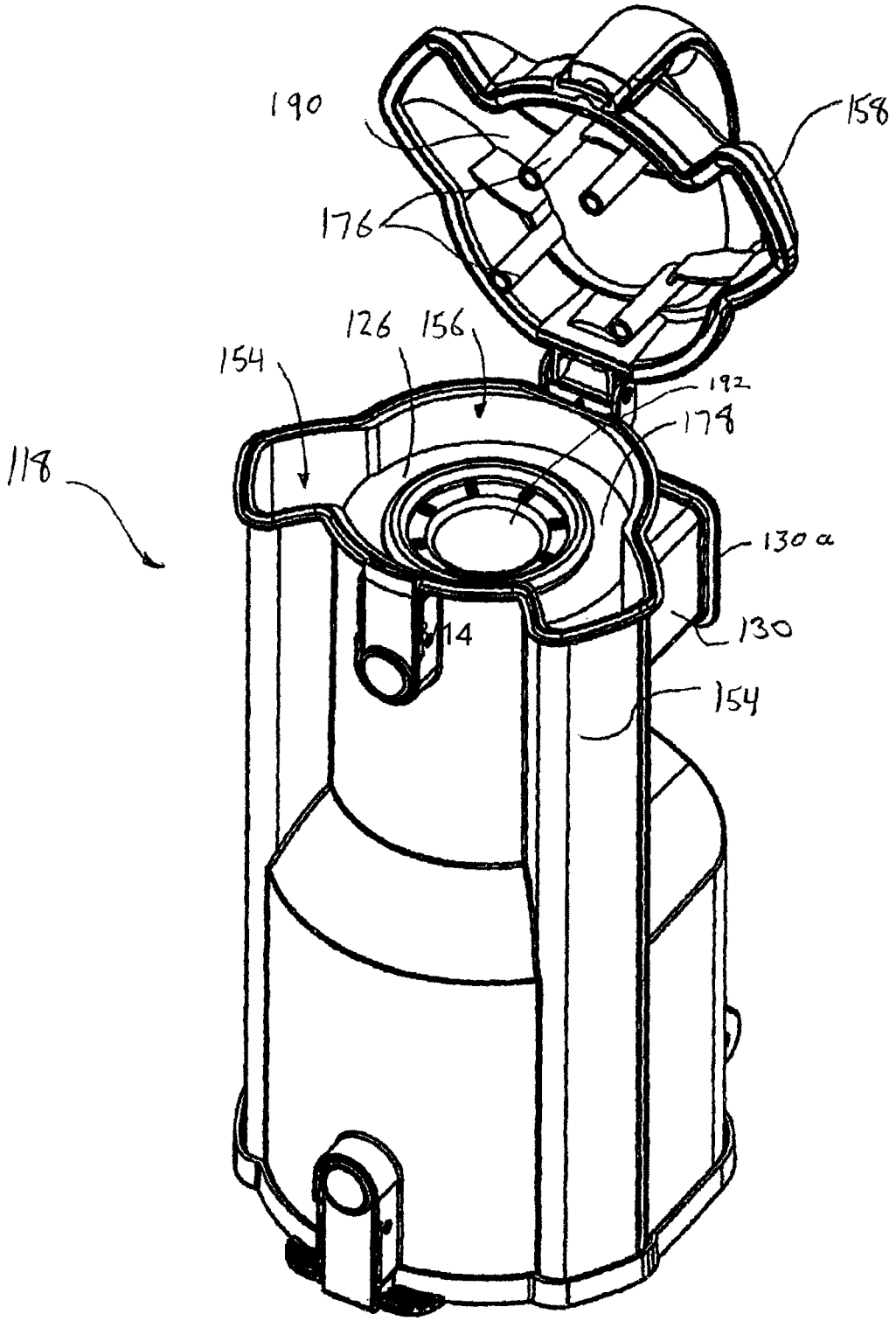
FIG. 4 is a top perspective view of the cyclone bin assembly of FIG. 2, with its lid open.

Referring to FIGS. 3 and 5, the opening 152 defines a passage 164 that has a passage height 160, measured parallel to the cyclone chamber axis 138. Conventional cyclone chamber designs include a generally elongate outlet passage that may extend into the interior of the cyclone chamber to a position substantially below the lower extent of the cyclone air inlet. Such air outlet passages have a solid, fluid impermeable wall, and are commonly referred to as vortex finders.

In accordance with another aspect of this disclosure, unlike conventional cyclone chamber designs, the height 160 of the air outlet passage 164 may be selected so that the walls of the outlet passage 164 do not substantially extend into the interior of the cyclone chamber 120. Preferably, the height 160 of outlet passage 164 may be selected to be less than the height 162 of the cyclone air inlet 130 and is preferably less than half the height 162 and more preferably less than a third of the height. As such, if a conduit extends into the screen 168 to define a longer passage 164, it may comprise a collar depending downwardly from inner surface 166 of first end wall 126.

More preferably, a collar is not provided so that outlet passage 164 does not extend beyond the inner surface 166 of the first end wall 126 (i.e., it does not extend into the interior volume 192 of screen 168). In the illustrated example, the height 160 is less than height 162, and is generally equal to the thickness 168 of the end wall 126. Reducing the height 160 of the outlet passage 164 may help reduce energy losses as air exits the cyclone chamber 120, which may help increase the efficiency of the surface cleaning apparatus 100.

The screen 168 may help prevent elongate material such as hair and larger dirt particles from exiting the cyclone chamber 120 via the opening 152. Screen 168 may be a shroud (e.g., a molded plastic member having a plurality of openings or perforations therein. Alternately, screen 168 may comprise a mesh material. The mesh material may be self-supporting (e.g., a metal mesh). If the mesh material is not self-supporting, then a frame may be provided. Any screen known in the art may be used.

It has been discovered that for example, that for certain air flows, having certain flow properties, the fluid permeable screen 168 can be used in place of a traditional, non-permeable vortex finder to help facilitate the cyclonic air flow pattern within the cyclone chamber 120. For example, it has been discovered that if the surface cleaning apparatus 100 operates with a given combination of operating power and air flow rate, positioning the screen 168 within the cyclone chamber 120 may be sufficient to facilitate cyclonic flow of the air, without passing directly to exit the cyclone chamber 120 via the outlet passage 152 and therefore bypassing the cyclonic cleaning stage.

For example, the use of a screen 168, as opposed to a traditional non-permeable vortex finder, is sufficient to facilitate operation of the surface cleaning apparatus 110 when the surface cleaning apparatus 100 produces approximately 50 air watts of power (or less), preferably 40 air watts of power or less and optionally 30 air watts of power or less and/or operates an air flow rate of approximately 1.3 cubic meters per minute or less, preferably 1.2 cubic meters per minute or less and optionally 1.1 cubic meters per minute or less. The suction motor used in such a surface cleaning apparatus 100 may have a power requirement of 500 watts or less, and preferably has a power requirement of less than 200 watts.

As exemplified, screen 168 comprises on or more fluid permeable regions 170 that are covered with a fluid permeable material 180 (e.g., a mesh material) extending between non-permeable frame members 172. The permeable material 180 comprises a plurality of openings 182 to allow air to flow therethrough and may be a synthetic material (e.g., plastic). The permeability of the fluid permeable regions, and the corresponding flow resistance of the screen 168, may be varied by varying the properties of the permeable material 180, including, for example the size and/or shape of the openings 182. For example, the openings 182 can be configured to have a diameter or maximum height that is less than 8 mm in size, preferably less than 6 mm, more preferably less than 4 mm and may be less than 2 mm.

Preferably, the screen 168 has a height 186 that is greater than the height 162 of the outlet **130*b* of the air inlet 130. Optionally, the screen 168 can be configured so that the height 186 is between about 0.5 and 4 times larger than height 162. Preferably, the height 186 is between about 1 and about 3 times the height 162 of the outlet 130*b* of the air inlet 130, and more preferably is about 2 times the height 162 of the outlet 130*b* of the air inlet 130**.

Figure 8:
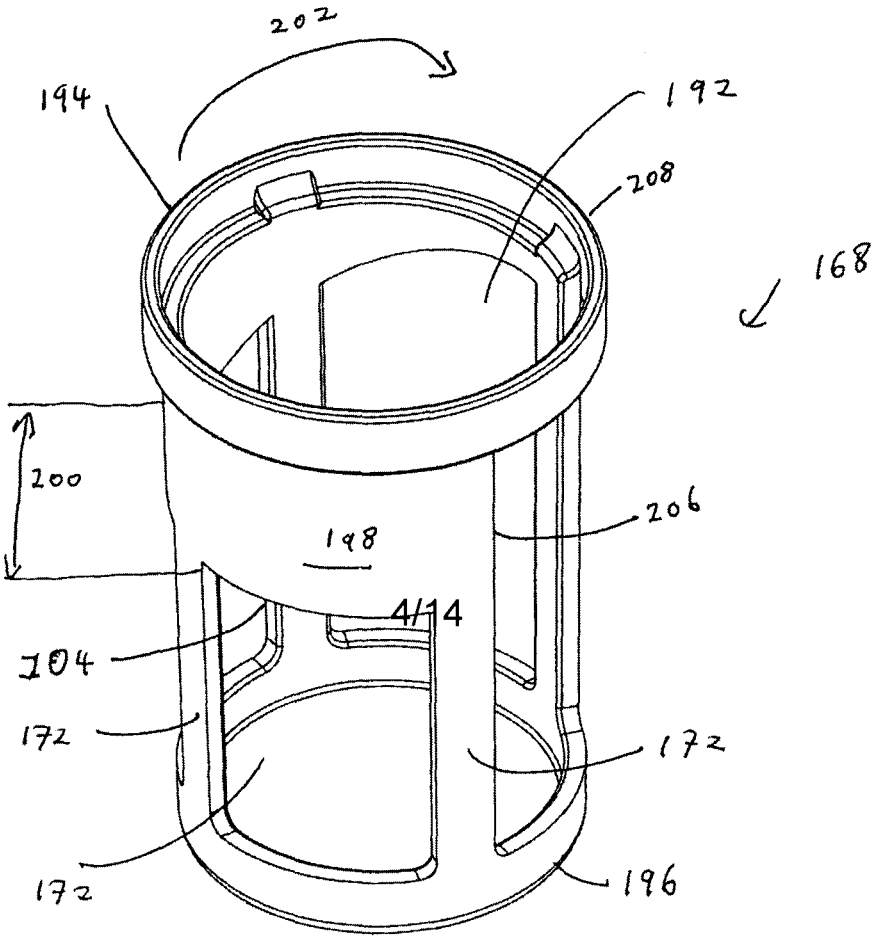
FIG. 8 is a perspective view of an alternate screen with the mesh removed from the screen.
Figure 9:
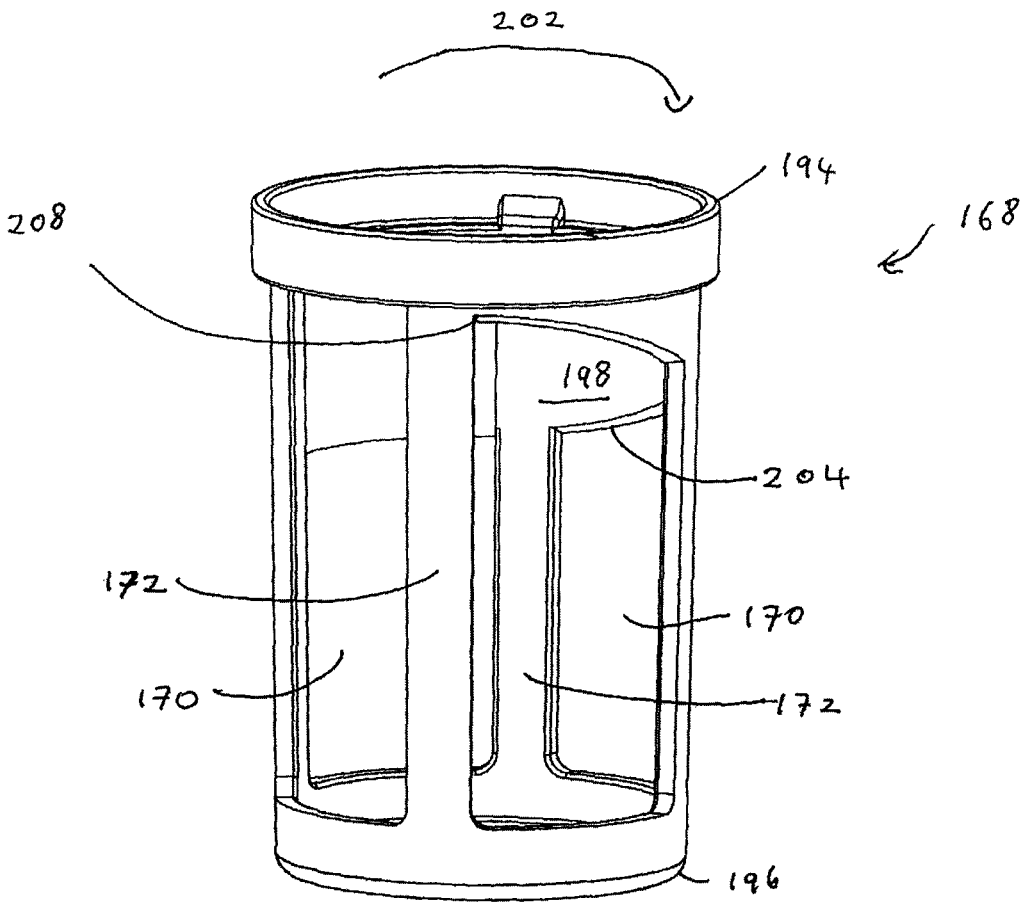
FIG. 9 is a perspective view of another side of the screen of FIG. 8 with the mesh removed from the screen.
Figure 10:
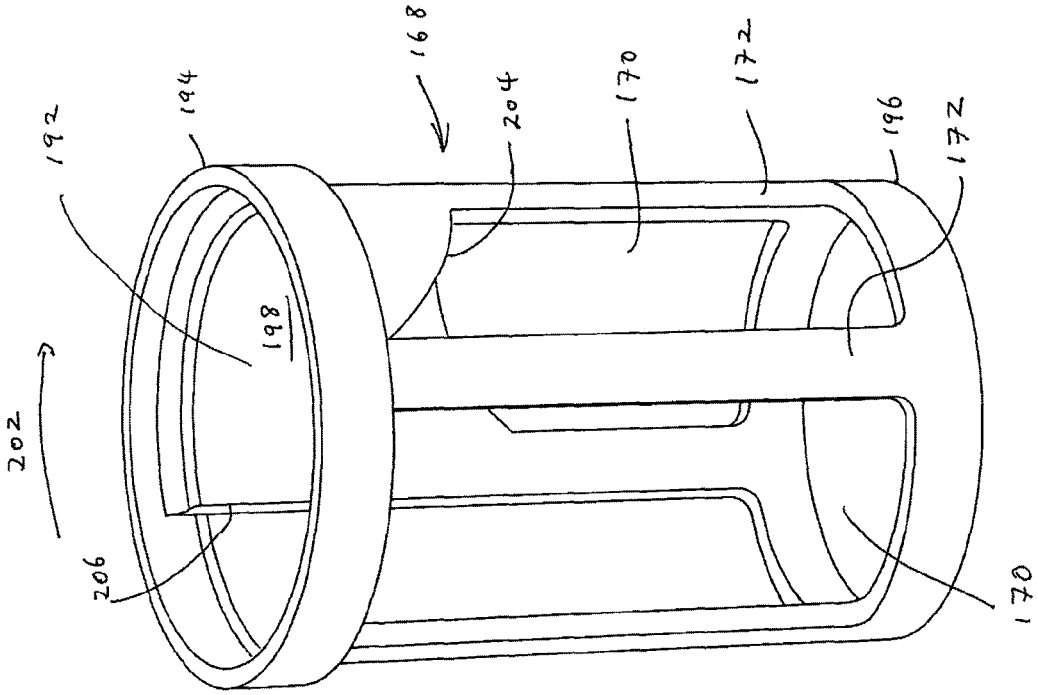
FIG. 10 is a perspective view of a further alternate screen with the mesh removed from the screen.
Figure 11:
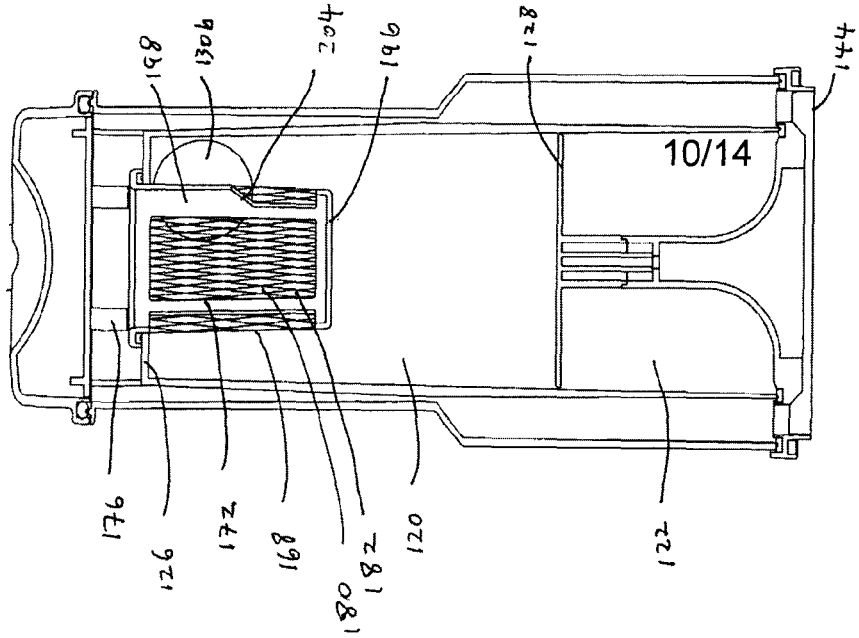
FIG. 11 is a section view of the cyclone bin assembly of FIG. 6, taken along line 7-7 in FIG. 6 and incorporating the screen of FIG. 10.
Figure 12:
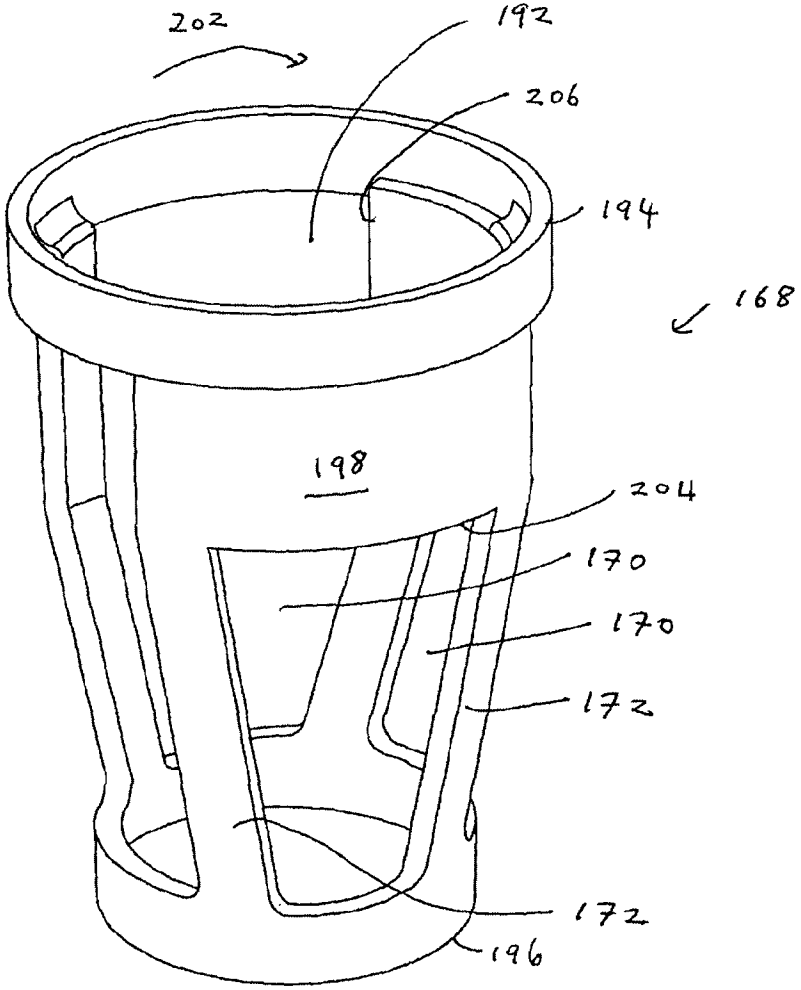
FIG. 12 is a perspective view of a further alternate screen with the mesh removed from the screen.
Figure 13:
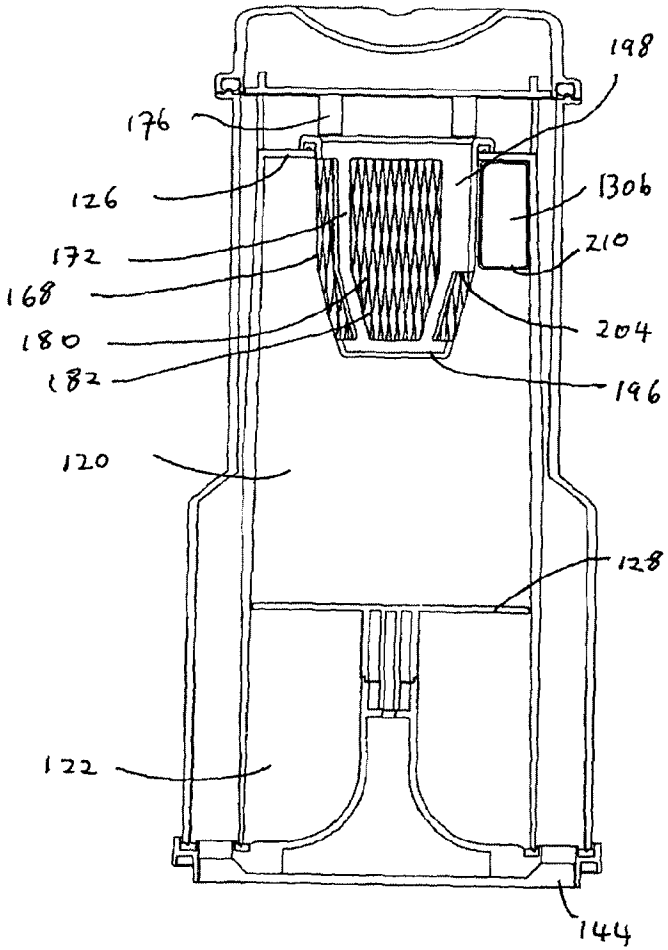
FIG. 13 is a section view of the cyclone bin assembly of FIG. 6, taken along line 7-7 in FIG. 6 and incorporating the screen of FIG. 12.
Figure 14:
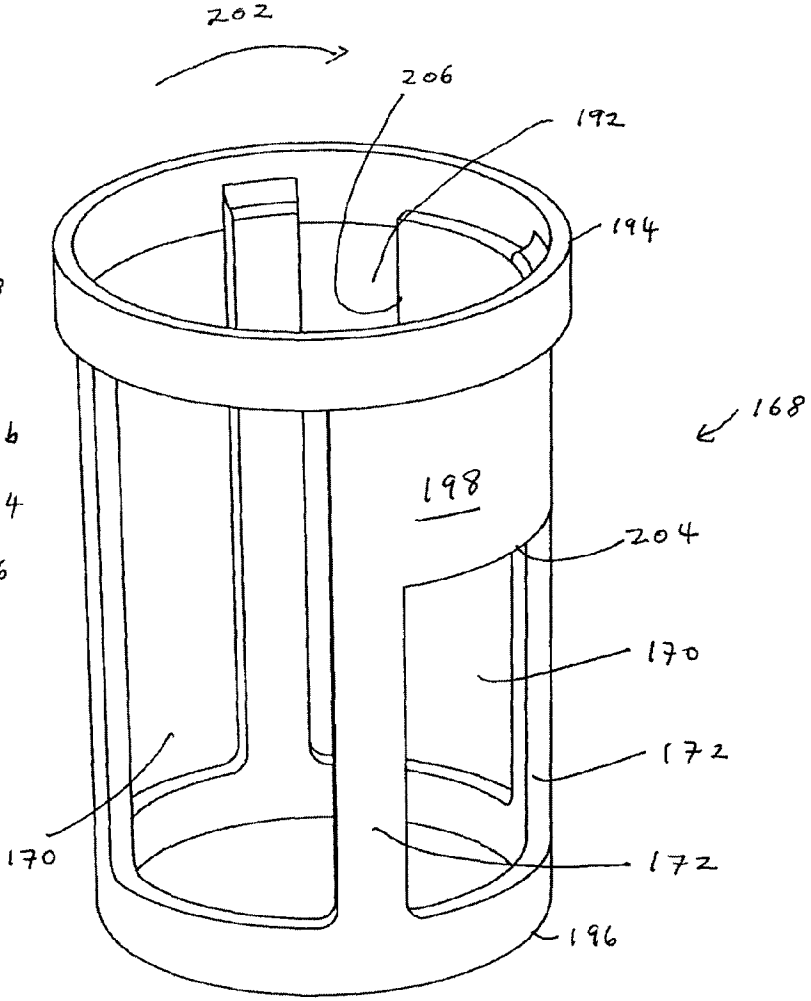
FIG. 14 is a perspective view of a further alternate screen with the mesh removed from the screen.
Figure 15:
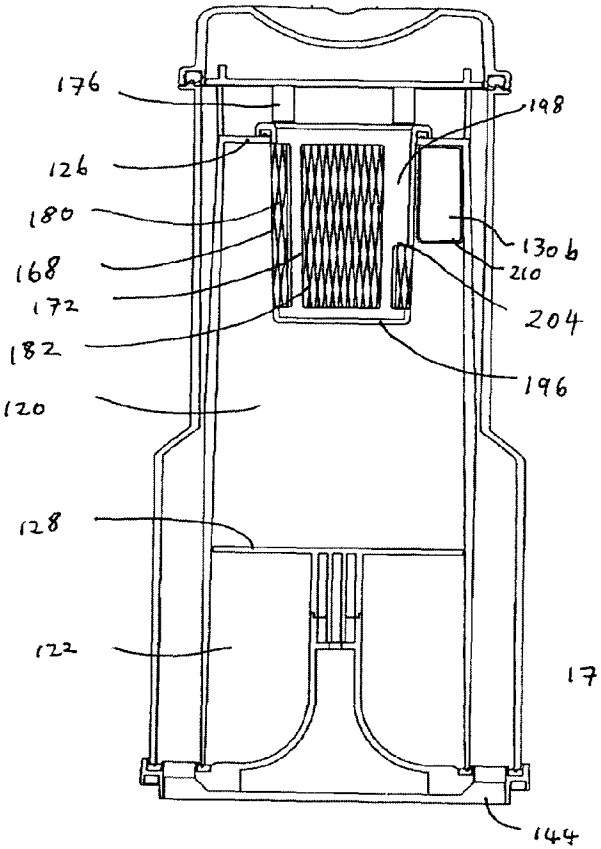
FIG. 15 is a section view of the cyclone bin assembly of FIG. 6, taken along line 7-7 in FIG. 6 and incorporating the screen of FIG. 14.
Figure 16:
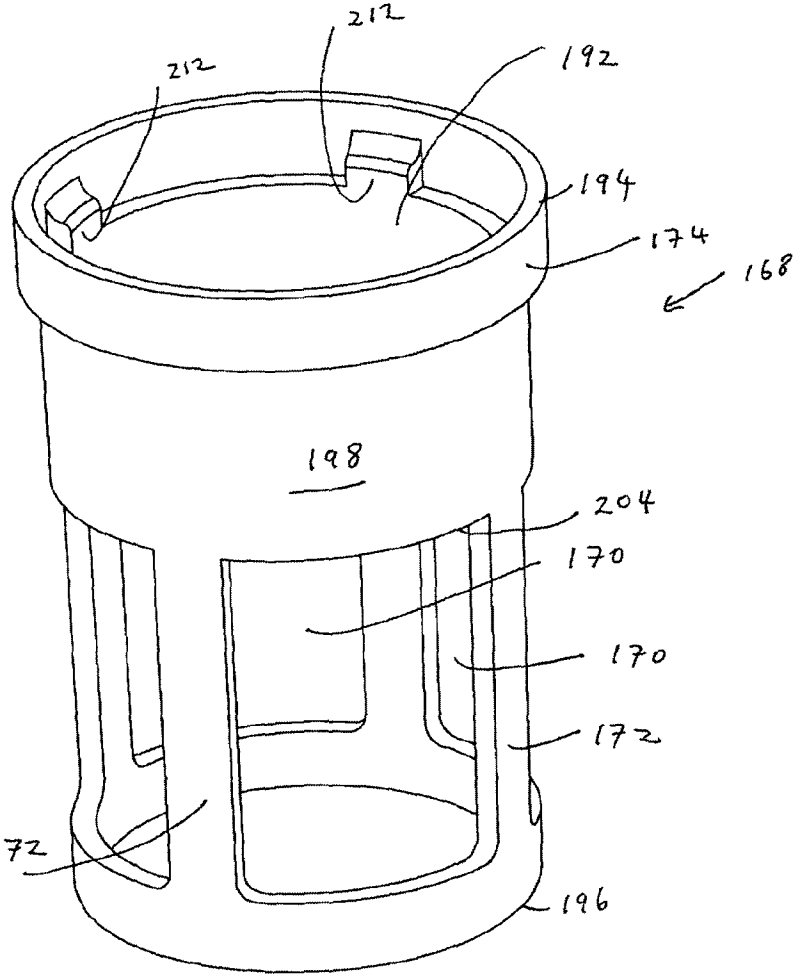
FIG. 16 is a perspective view of a further alternate screen with the mesh removed from the screen.
Figure 17:
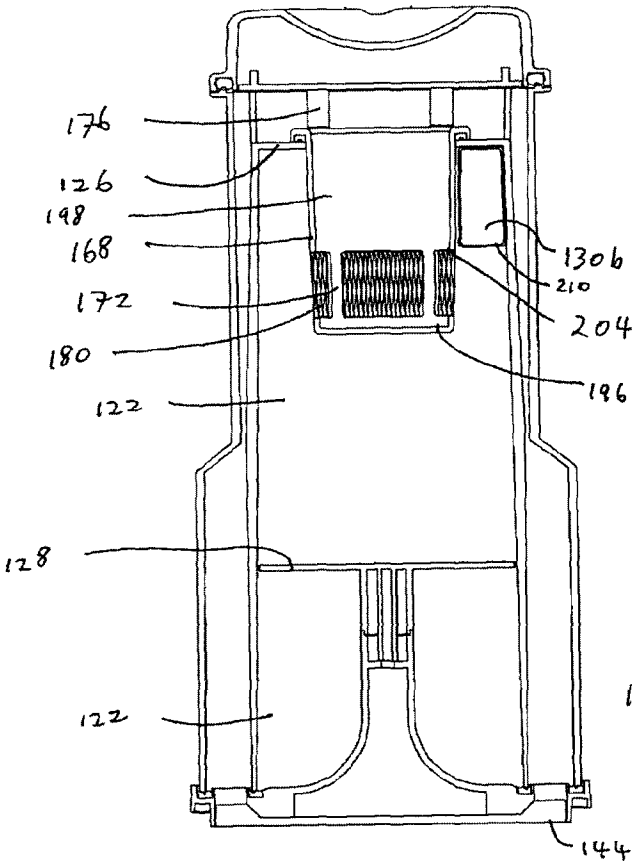
FIG. 17 is a section view of the cyclone bin assembly of FIG. 6, taken along line 7-7 in FIG. 6 and incorporating the screen of FIG. 16.
Figure 18:
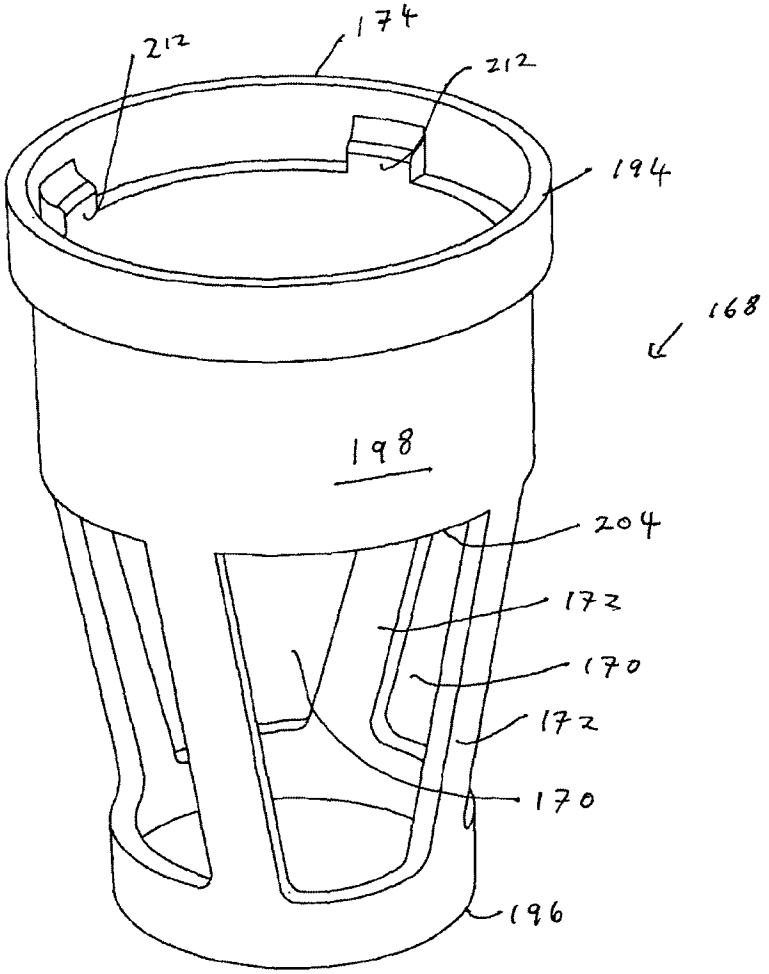
FIG. 18 is a perspective view of a further alternate screen with the mesh removed from the screen; and, FIG. 19 is a section view of the cyclone bin assembly of FIG. 6, taken along line 7-7 in FIG. 6 and incorporating the screen of FIG. 18.
Figure 19:
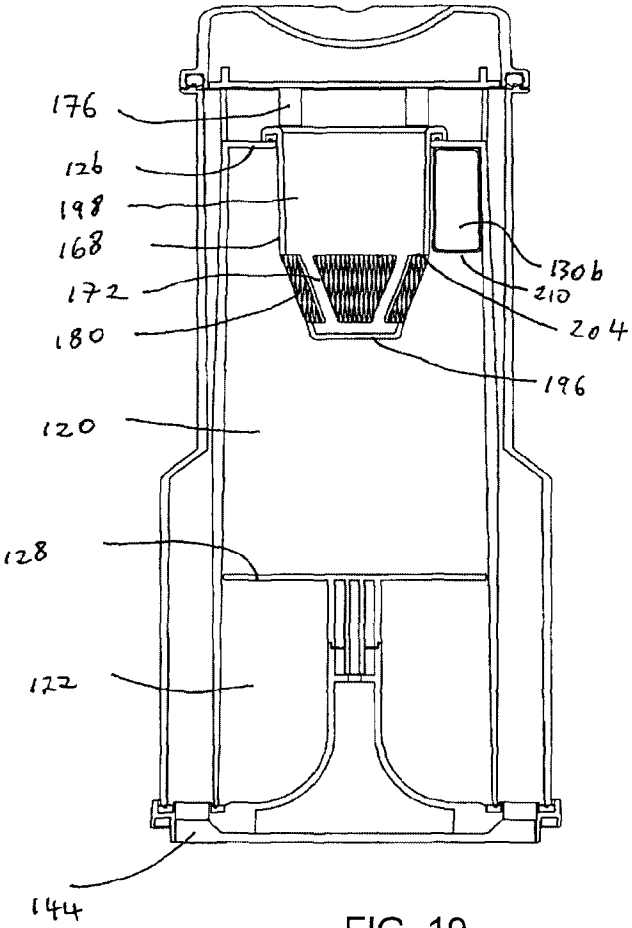

Referring to the screen exemplified in FIGS. 8 and 9, screen 168 is positioned in the cyclone chamber 120 upstream of the cyclone air outlet. Screen 168 has an outlet end 194 and a distal end 196 spaced from and facing the outlet end 194. The outlet end of the screen is open and defines an airflow passage which is at least the same size as an airflow passage defined by the opening 152. For example, if the screen 168 and the outlet 152 are circular, then open end 194 may have a diameter proximate the diameter of opening 152. Therefore, the outlet end 194 of the screen 168 may be positioned adjacent the end wall 126.

Preferably, screen 168 comprises a solid wall 198 that faces the outlet **130*b* of cyclone air inlet 130. Solid wall 198 may assist in preventing air bypassing cyclone chamber 120 by travelling directly to opening 152 and may assist in creating cyclonic flow in cyclone chamber 120 by defining an annular air flow passage at the upper end of cyclone chamber 120. Preferably, the solid wall 198 has a height 200 that is greater than the height 162 of the outlet 130***b* of cyclone air inlet 130.

In some embodiments, solid wall 198 may have a uniform height (see for example FIGS. 6, 7 and 12-19. In such cases, the height 200 of solid wall is preferable greater than the height of outlet 130*b* of cyclone air inlet 130. In some embodiments, solid wall 198 may extend all the way around screen 198 (see for example FIGS. 6, 7 and 16-19). In other cases, solid wall may extend only part way around screen 168 (see for example FIGS. 12-15).

In other cases, (see for example FIGS. 8-11) the height 200 of the solid wall may be variable and preferably decreases in the direction of rotation 202 of the air in cyclone chamber 120. In such a case, the height 200 of the portion of solid wall 198 facing outlet 130*b* of cyclone air inlet 130 is preferable greater than the height of outlet 130*b* of cyclone air inlet 130. For example, the height 200 of upstream end 206 of solid wall 198 is preferable greater than the height of outlet 130*b* of cyclone air inlet 130. As the air rotates in direction 202 in cyclone chamber 120, the air will move downwardly towards lower end 128 of cyclone chamber 120. Accordingly, the height of the solid wall 198 may decrease as there may not be cyclonic flow around a portion of the upper end of screen 168. For example, at a position about ½ of ¾ of the distance around screen 168 from outlet 130*b*, there may be no cyclonic flow around the upper portion of screen 168. Accordingly, solid wall 198 is not required to prevent bypass of cyclone chamber 120. Preferably, the air rotating in the direction 202 adjacent the screen has a height and the height 200 of the solid wall is greater than the height of the air. As exemplified in FIGS. 8 and 9, the height 200 of solid wall 168 decreases to 0 or essentially 0 at a position 208 which is about ¾ of the distance around screen 168 from outlet 130*b*. An advantage of this design is that mesh 180 may be provided in an region that would otherwise be occupied by solid wall 198, thereby increasing the mesh surface area and therefore increasing the surface area available for air to mass through to opening 198.

Accordingly, solid wall 198 may have a distal end 204 that is spaced from end wall 126 of the cyclone chamber 120 by a first distance or height 200 and the outlet 130*b* of the cyclone air inlet 130 may have a distal end 210 spaced from an end wall of the cyclone chamber 126 by a second distance or height 162 and the first distance is greater than the second distance.

The distal end 196 of screen 168 may be closed (e.g., a solid surface) but it is preferably open (e.g., covered by mesh 180).

Optionally, the lid 158 of the cyclone bin assembly 118 is openable to allow a user to remove the screen 168. In the illustrated example, the lid 158 is hinged and can pivot open to allow access to the removable of the screen 168. Alternatively, the lid 158 can be detachable or openable by any other means.

If screen 168 is removable and if solid wall 198 does not extend all around screen 168 or if it only has a portion with a height 200 greater than the height 162 of outlet 130*b*, then one or more alignment members may be provided to assist a user to reinsert screen in the correct orientation (e.g., with the portion of screen 168 that has a height 200 greater than the height 162 of outlet 130*b* facing outlet 130*b*). For example, as exemplified in FIGS. 16-19, alignment notches 212 may be provided in rim 174 of screen 168. These alignment notches 212 may mate with protrusions provided on the outer surface of end wall 126 on which rim 174 seats. In a particularly preferred embodiment, the notches 212 may be angularly spaced so that screen 168 may only be reinserted in the correct position. Any other alignment means or inter-engagement members may be sued.

Screen 168 may be of various shapes. In the illustrated example, outlet 152 and the screen 168 have generally round cross sectional shapes, and the screen 168 is received in the outlet 152. Optionally, the screen 168 may be configured to have a cylindrical shape (see FIGS. 4-11 and 14-17), a lower portion that is generally frusto-conical in shape (see FIGS. 12, 13, 18 and 19) or any other suitable shape.

The screen 168 may comprise an annular rim 174. When screen 168 is positioned in cyclone chamber 120, the rim 174 may be positioned above, and preferably rests on the upper wall 126 such that the screen 168 is suspended from the rim 174. A gasket 175 or other sealing member may be provided between the rim 174 and the upper wall 126 to help seal the rim 174 against the upper wall 126.

Optionally, if the screen 168 is removable, a member to secure the screen in portion may be provided. For example, as exemplified, the lid 158 may include one or more engagement member that can secure the screen 168 in position when the lid 158 is closed. In the illustrated example, the engagement member comprises four securing legs 176 extending from the inner surface 190 of lid 158. When the lid 158 is closed, the securing legs 176 rest on the rim 174 and press the rim 174 against the upper wall 126. Providing securing legs 176 to hold the rim 174 in place may eliminate the need to use additional fasteners or attachment members to hold the screen 168 in position. The legs 176 are preferably spaced apart from each other around the perimeter of the rim 174. Spacing the legs 176 apart from each other may help to provide a distributed holding force and may help facilitate airflow between the legs 176, from the outlet passage 152 to the outlet conduits 154. Optionally, a different number of legs 176, other type of holding structure, including for example a bayonet mount, male and female engagement members provided on screen 168 and end wall 126, or other type of fastening members can be used to hold the screen 168 in place.

In the illustrated example, the screen 168 may be received in the outlet 152 in a plurality of rotational alignment positions, and need not be oriented in a predetermined direction or alignment relative to the upper wall 126 of the cyclone chamber 120.

Optionally, some or all of the upper wall 126 of the cyclone chamber 120 may be removable with the screen 168. Removing a portion of the upper wall 126 may allow a user to access the interior of the cyclone chamber 120. Optionally, the removable portion of the upper wall 126 may be an annular band 178 that surrounds the outlet 152. Removing some or all of the upper wall 126 while the floors 128 and 144 are open may allow simultaneous access to both ends of the cyclone bin assembly 118, which may help a user to clean the interior of the cyclone bin assembly 118.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising:

(a) a cyclone chamber having a longitudinal axis defining a longitudinal direction, an end wall, a cyclone air inlet located at a longitudinal position along the longitudinal axis, wherein air exits the cyclone air inlet into the cyclone chamber in an air inflow direction, the cyclone air inlet being quadrilateral in shape in a direction perpendicular to the air flow direction;

(b) a screen positioned in the cyclone chamber upstream of an air outlet of the cyclone, the screen comprising at the longitudinal position both a solid wall portion and a fluid permeable portion, the solid wall portion facing the cyclone air inlet, the fluid permeable portion containing air flow passages, and the fluid permeable portion being spaced around the longitudinal axis from the cyclone air inlet, wherein the solid wall portion extends continuously around at least one quarter of a circumference of the screen; and, (c) a suction motor in fluid communication with the cyclone chamber, wherein a projection of the cyclone air inlet in the air inflow direction does not intersect the solid wall portion and, wherein the solid wall portion has a height extending in the longitudinal direction that is greater than a height of the cyclone air inlet in the longitudinal direction and, wherein the solid wall portion has a height extending in the longitudinal direction that is less than about half a length of the screen in the longitudinal direction.

2. The surface cleaning apparatus of claim 1 wherein the screen has an interior volume that is fully open in that the interior volume is free of other structures.

3. The surface cleaning apparatus of claim 1 wherein the solid wall portion has a distal end spaced from the end wall of the cyclone chamber by a first distance and the cyclone air inlet has a distal end spaced from the end wall of the cyclone chamber by a second distance and the first distance is greater than the second distance.

4. The surface cleaning apparatus of claim 1 wherein air rotates in the cyclone chamber in a direction and a height of the solid wall portion in the longitudinal direction decreases in the direction.

5. The surface cleaning apparatus of claim 1 wherein the cyclone air inlet is configured to direct air entering the cyclone chamber to rotate around the screen in a direction so that the air rotating in the direction adjacent the screen has a height in the longitudinal direction and a height of the solid wall portion in the longitudinal direction is greater than the height of the air rotating in the direction adjacent the screen.

6. The surface cleaning apparatus of claim 1 wherein at least a portion of the screen is tapered.

7. The surface cleaning apparatus of claim 1 wherein the screen is tapered.

8. The surface cleaning apparatus of claim 1 wherein the screen has a first end located at an air outlet end of the cyclone chamber and a second opposed end axially inwardly therefrom and at least a portion of the screen towards the second opposed end is tapered.

9. The surface cleaning apparatus of claim 1 wherein the cyclone air inlet has a first end located at an air outlet end of the cyclone chamber and a second opposed end located axially inwardly therefrom and the screen has a first end located at an air outlet end of the cyclone chamber and a second opposed end axially inwardly therefrom wherein a portion of the screen positioned axially inwardly from the second opposed end of the cyclone air inlet is tapered.

10. The surface cleaning apparatus of claim 1 wherein the cyclone air inlet has a first end and a second opposed end located axially inwardly therefrom and the screen has a first end and a second opposed end axially inwardly therefrom wherein a portion of the screen positioned axially inwardly from the second opposed end of the cyclone air inlet is tapered.

11. The surface cleaning apparatus of claim 1 wherein the cyclone air inlet is rectangular in shape.

12. The surface cleaning apparatus of claim 1 wherein the solid wall portion is integral with the screen.

* * * * *